US006717495B2

(12) United States Patent
Kondoh et al.

(10) Patent No.: US 6,717,495 B2
(45) Date of Patent: Apr. 6, 2004

(54) CONDUCTIVE LIQUID-BASED LATCHING SWITCH DEVICE

(75) Inventors: You Kondoh, Yamato (JP); Tsutomu Takanaka, Hachioji (JP)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 10/080,643

(22) Filed: Feb. 21, 2002

(65) Prior Publication Data

US 2002/0121949 A1 Sep. 5, 2002

(30) Foreign Application Priority Data

Feb. 23, 2001 (JP) ..... 2001-049481

(51) Int. Cl.[7] ..... H01H 29/00
(52) U.S. Cl. ..... 335/47; 200/182
(58) Field of Search ..... 335/47, 50–58, 335/78–86; 200/181–193, 223–225; 361/699–704

(56) References Cited

U.S. PATENT DOCUMENTS 5,912,606 A * 6/1999 Nethanson et al. ..... 335/47
6,323,447 B1 11/2001 Kondoh et al.
6,501,354 B1 * 12/2002 Gutierrez et al. ..... 335/47

FOREIGN PATENT DOCUMENTS

| | | |
|---|---|---|
| JP | A47-21645 | 11/1972 |
| JP | 9-161640 | 6/1997 |
| JP | A 9161640 | 6/2000 |
| WO | WO 00/41198 | 12/1999 |
| WO | WO 01/46975 | 12/2000 |
| WO | WO 01/46975 | 6/2001 |

* cited by examiner

*Primary Examiner*—Lincoln Donovan
(74) *Attorney, Agent, or Firm*—Ian Hardcastle

(57) ABSTRACT

The latching switch device includes a passage, a first cavity, a second cavity, a channel extending from each cavity to the passage, non-conductive fluid located the cavities, conductive liquid located in the passage, a first electrode, a second electrode and a latching structure associated with each channel. The passage is elongate. The channels are spatially separated from one another along the length of the passage. The electrodes are in electrical contact with the conductive liquid and are located on opposite sides of one of the channels. The conductive liquid includes free surfaces. Each latching structure includes energy barriers located in the passage on opposite sides of the channel. The energy barriers interact with the free surfaces of the conductive liquid to hold the free surfaces apart from one another.

20 Claims, 5 Drawing Sheets

CONDUCTIVE LIQUID-BASED LATCHING SWITCH DEVICE

BACKGROUND OF THE INVENTION

Switch devices based on conductive liquids have been known since the 19th century. Recently, electrically-controlled, highly-miniaturized conductive liquid-based switches have been proposed. Such switches can be fabricated in a semiconductor substrate, and therefore can be integrated with other electrical devices fabricated in the substrate. Such switches have the advantage that they provide a substantially higher isolation between the control signal and the switched circuit than switch devices based on semiconductor devices.

Published Japanese Patent Application No. S47-21645 discloses an example of a switch device for electrically switching solid electrodes by means of a conductive liquid. In this switch device, a conductive liquid such as mercury is movably disposed inside a cylinder. The switch device is designed so that the conductive liquid is moved to one side by a pressure differential in a gas provided on both sides of the conductive liquid. When the conductive liquid moves, it touches electrodes that extend into the interior of the cylinder and forms an electrical connection between the electrodes. A drawback to this structure, however, is that the electrical connection characteristics of the switch device deteriorate as a result of the surfaces of the electrodes being modified over time by intermittent contact with the conductive liquid.

U.S. Pat. No. 6,323,447, assigned to the assignees of this disclosure and, for the United States, incorporated herein by reference, discloses a switch device that solves the above-mentioned problem. In this switch device, the electrical path is selectively changed from a connected state to a disconnected state by a conductive liquid such as mercury. However, the electrodes remain in constant contact with the conductive liquid, and the connected or disconnected state of the electrical path is determined by whether the conductive liquid exists as a single entity (connected state) or is separated into two discontinuous entities (disconnected state). This eliminates the problem of poor connections that was a disadvantage of the switch device disclosed in published Japanese Patent Application No. S47-21645.

The switch device described in U.S. Pat. No. 6,323,447 is composed of an elongate passage filled with a conductive liquid and having electrodes located at its ends, a first cavity filled with non-conductive fluid and connected to approximately the mid-point of the passage by a single channel, a second cavity filled with non-conductive fluid and connected to near the ends of the passage by two channels. A heater is located in each cavity.

The heater in the first cavity is activated to switch the switch device to its OFF state. Heat generated by the heater causes the non-conductive fluid in the cavity to expand. The excess volume of the non-conductive fluid passes though the single channel to the passage where it forms a gap in the conductive liquid. The gap filled with the non-conductive fluid electrically insulates the electrodes from one another. The conductive liquid displaced by the non-conductive fluid enters the channels at the ends of the passage.

The heater in the second cavity is activated to switch the switch device to its ON state. Heat generated by the heater causes the non-conductive fluid in the cavity to expand. The excess volume of the non-conductive fluid passes though the two channels to displace the conductive liquid from the channels. The conductive liquid returning to the passage displaces the non-conductive fluid from the gap and the conductive liquid returns to its continuous state. In this state, the conductive liquid electrically connects the electrodes.

Some embodiments of the switch device described in U.S. Pat. No. 6,323,447 include latching structures located in the channels connecting the cavities to the passage. The latching structures hold the switch device in the switching state to which it has been switched after the respective heater has been de-energized. The latching structures require the conductive liquid to enter the channels, which have somewhat smaller cross-sectional dimensions than the passage. This increases both the energy required to operate the switch and the time required to change the switching state of the switch.

Moreover, the latching structures may provide inadequate latching reliability for some applications. A substantial amount of the conductive liquid connects each latching structure to the respective surface of the conductive liquid. The conductive liquid connecting the latching structure to the surface is not fully bounded. A stimulus, such as vibration or a temperature change, can therefore cause the form of the conductive liquid to change to one that changes the switching state of the switch device.

Published International Patent Application No. WO 01/46975, assigned to the assignees of this disclosure and, for the United States, incorporated herein by reference, discloses a switch device in which the conductive liquid is confined to the passage. This decreases both the energy required to operate the switch and the time required to change the switching state of the switch compared with the switch device shown disclosed in U.S. Pat. No. 6,323,447. FIGS. 1A and 1B show an example 10 of the conductive liquid-based switch device disclosed in published International Patent Application No. WO 01/46975. Switch device 10 is composed of elongate passage 12, chambers 14 and 16, channels 18 and 20, non-conductive fluid 22 and 24, conductive liquid 26, electrodes 31 and 32 and heaters 50 and 52. Electrodes 30, 31 and 32 are disposed along the length of passage 12. Conductive liquid 26 is located in the passage and has a volume less than that of the passage so that the conductive liquid only partially fills the passage. The conductive liquid therefore exists as a number of conductive liquid portions 40, 41 and 42.

Channel 18 extends from cavity 14 to passage 12. Channel 20 extends from cavity 16 to the passage. The channels are offset from one another along the length of the passage and are located between electrode 30 and electrode 31 and between electrode 31 and electrode 32, respectively. Cavities 14 and 16 and channels 18 and 20 are filled with non-conductive fluid 22 and 24, respectively. Heaters 50 and 52 are located in cavities 14 and 16, respectively, for regulating the internal pressure of the non-conductive fluid in the cavities. Channels 18 and 20 transfer the non-conductive fluid in cavities 14 and 16, respectively, to and from passage 12.

The switching operation of switch device 10 is as follows. In the initial switching state shown in FIG. 1A, heater 50 is energized and heater 52 is not energized. Conductive liquid portions 41 and 42 are joined together to form conductive liquid portion 41, 42. Conductive liquid portion 41, 42 is separated from conductive liquid portion 40 by non-conductive fluid 22. Thus, conductive liquid portion 41, 42 electrically connects electrode 31 to electrode 32, but non-conductive fluid 22 between conductive liquid portion 41, 42 and conductive liquid portion 40 electrically insulates electrode 30 from electrode 31.

Switch device 10 switches to the switching state shown in FIG. 1B when heater 50 is de-energized and heater 52 is energized. Heat generated by heater 52 causes non-conductive fluid 24 in cavity 16 to expand. Non-conductive fluid 24 passes through channel 20 and enters passage 12. In the passage, non-conductive fluid 24 forms a gap in conductive liquid portion 41, 42 (FIG. 1A). The gap separates conductive liquid portion 41, 42 into non-contiguous conductive liquid portions 41 and 42. Separation of conductive liquid portion 41, 42 into conductive liquid portions 41 and 42 expels non-conductive fluid 22 from the gap between conductive liquid portions 40 and 41. This allows conductive liquid portions 40 and 41 to unite to form conductive liquid portion 40, 41. Conductive liquid portion 40, 41 electrically connects electrode 30 to electrode 31. Non-conductive fluid 22 in the gap between conductive liquid portion 42 and conductive liquid portion 40, 41 electrically insulates electrode 31 from electrode 32. Switch device 10 stays in the switching state shown in FIG. 1B for as long as heater 52 is energized.

Switch device 10 returns to the switching state shown in FIG. 1A when heater 52 is de-energized and heater 50 is energized. Heat generated by heater 50 causes non-conductive fluid 22 in cavity 14 to expand. Non-conductive fluid 22 passes though channel 18 and enters passage 12. In the passage, non-conductive fluid 22 forms a gap in conductive liquid portion 40, 41 (FIG. 1B). The gap separates conductive liquid portion 40, 41 into non-contiguous conductive liquid portions 40 and 41. Separation of conductive liquid portion 40, 41 expels non-conductive fluid 24 from the gap between conductive liquid portions 41 and 42. This allows conductive liquid portions 41 and 42 to unite to form conductive liquid portion 41, 42. Conductive liquid portion 41, 42 electrically connects electrode 32 to electrode 31. Non-conductive fluid 22 electrically insulates electrode 30 from electrode 31.

Switch device 10 is non-latching. Heater 50 must be continuously energized to hold the switch device in the switching state shown in FIG. 1A and heater 52 must be continuously energized to hold the switch device in the switching state shown in FIG. 1B. De-energizing heater 50 after switching the switch device to the switching state shown in FIG. 1A would incur the risk that the resulting contraction of non-conductive fluid 22 would allow conductive liquid portions 40 and 41, 42 to unite to form an electrical connection between electrodes 30 and 31. The contraction of non-conductive fluid 22 would incur the additional risk that conductive liquid portion 41, 42 would fragment into conductive liquid portions 41 and 42 to break the electrical connection between electrodes 31 and 32. In other words, there is the risk that, on de-energizing heater 50, switch device 10 would spontaneously revert to the switching state shown in FIG. 1B or to an indeterminate switching state. Corresponding risks would exist if heater 52 were de-energized off after switching switch device 10 to the switching state shown in FIG. 1B.

Thus, energy has to be continuously expended to maintain the switch device 10 in the switching states to which it has been switched. This is undesirable in terms of expense, energy conservation and energy dissipation. Attempting to save energy by de-energizing the heaters after switching incurs the risk of the switch device reverting to the other switching state or to an indeterminate state. In many applications such risks are unacceptable.

What is needed, therefore, is a conductive liquid-based switch device that requires a relatively small input of energy to change it rapidly from one switching state to the other. What is also needed is a conductive liquid-based switch device that is latching in each of its switching states so that it only needs an input of energy to switch it from switching state to another. Finally, what is needed is a conductive liquid-based switch device that reliably maintains the switching state to which it has been switched without a continuous input of energy.

SUMMARY OF THE INVENTION

The invention provides a latching switch device that comprises a passage, a first cavity, a second cavity, a channel extending from each cavity to the passage, non-conductive fluid located the cavities, conductive liquid located in the passage, a first electrode, a second electrode and a latching structure associated with each channel. The passage is elongate. The channels are spatially separated from one another along the length of the passage. The electrodes are in electrical contact with the conductive liquid and are located on opposite sides of one of the channels. The conductive liquid includes free surfaces. Each latching structure includes energy barriers located in the passage on opposite sides of the channel. The energy barriers interact with the free surfaces of the conductive liquid to hold the free surfaces apart from one another.

The latching structure allows the heater to be de-energized after changing the switching state of the switch device without the risk of the switch device spontaneously reverting to the other switching state or to an indeterminate switching state. When the heater is de-energized, the non-conductive fluid contracts. However, the latching structure and, specifically, the energy barriers, hold the surfaces of the conductive liquid apart. As a result, the switch device reliably maintains the switching state to which it was switched when the heater was energized. The latching structure ensures that the switch device can only be switched to its other switching state by energizing the other heater.

Energizing the heaters only to change the switching state of the switch device and not to maintain the switch device in the corresponding switching state substantially reduces the power consumption of the switch device compared with conventional liquid conductor-based switch devices.

The latching structures interact directly with the free surfaces of the conductive liquid portions to keep the free surfaces apart and maintain the switch device in the switching state to which it has been switched. The latching structure is not connected to the free surfaces by a thread of conductive liquid whose form can change and allow the free surfaces to move into contact with one another. Also, one end of each conductive liquid portion is bounded by an end of passage and the other end of the conductive liquid portion is bounded by one of the energy barriers. Since the conductive liquid portion is bounded at both of its ends, its ability to change its form and open the electrical connection between the electrodes in contact with it is substantially reduced.

The invention also provides a latching switch device that comprises a passage, a first cavity, a second cavity, a channel extending from each cavity to the passage, non-conductive fluid located the cavities, conductive liquid located in the passage, a first electrode and a second electrode. The passage is elongate. The channels are spatially separated from one another along the length of the passage. The electrodes are in electrical contact with the conductive liquid and are located on opposite sides of one of the channels. The passage includes a latching structure associated with each channel. Each latching structure includes a first low surface energy portion, a high surface energy portion and a second low surface energy portion arranged in tandem along part of the length of the passage. The high surface energy portion is located at the channel. The low surface energy portions are structured to reduce the surface energy of the conductive liquid relative to the surface energy of the conductive liquid in the high surface energy portion.

In the latching structure associated with each channel, the low surface energy portions and the high surface energy portion collectively form two energy barriers located adjacent, and on opposite sides of, the channel. When the heater associated with the channel is energized to switch the switching state of the switch device, non-conductive fluid is output from the channel and divides the conductive liquid portion adjacent the channel into two smaller conductive liquid portions. This forms a free surface on each of the conductive liquid portions. The non-conductive fluid moves the free surfaces away from the channel and across the energy barriers.

DETAILED DESCRIPTION OF THE INVENTION

Figure 2A:
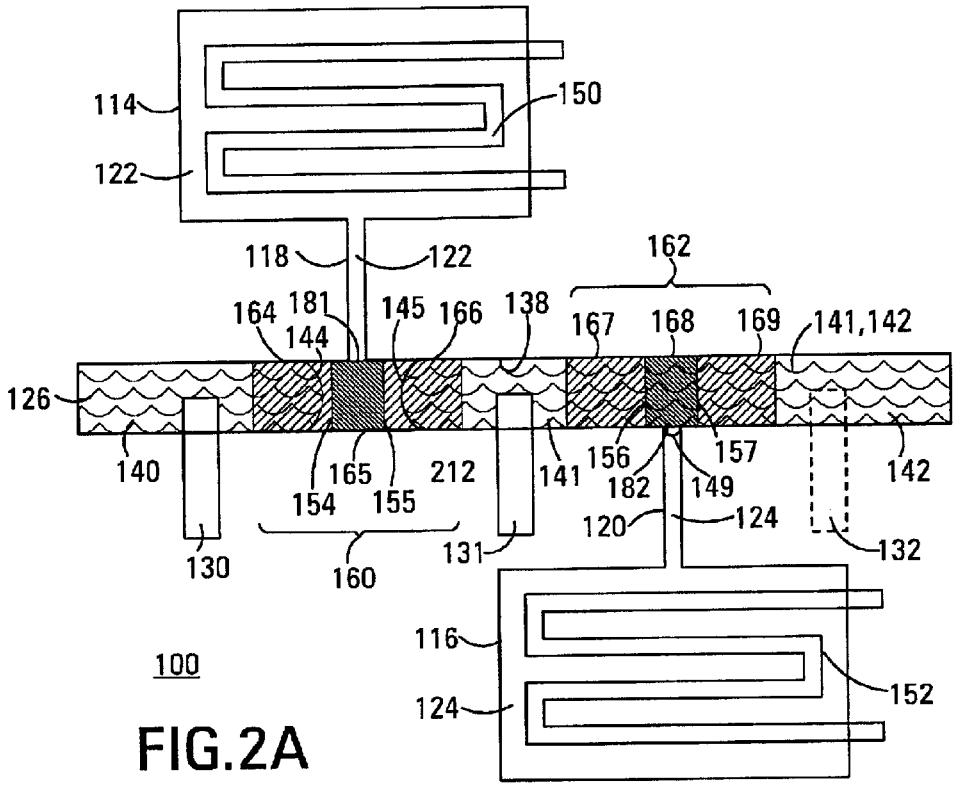
FIG. 2A is a plan view of a first embodiment of a conductive liquid-based switch device according to the invention in a first switching state.
Figure 2B:
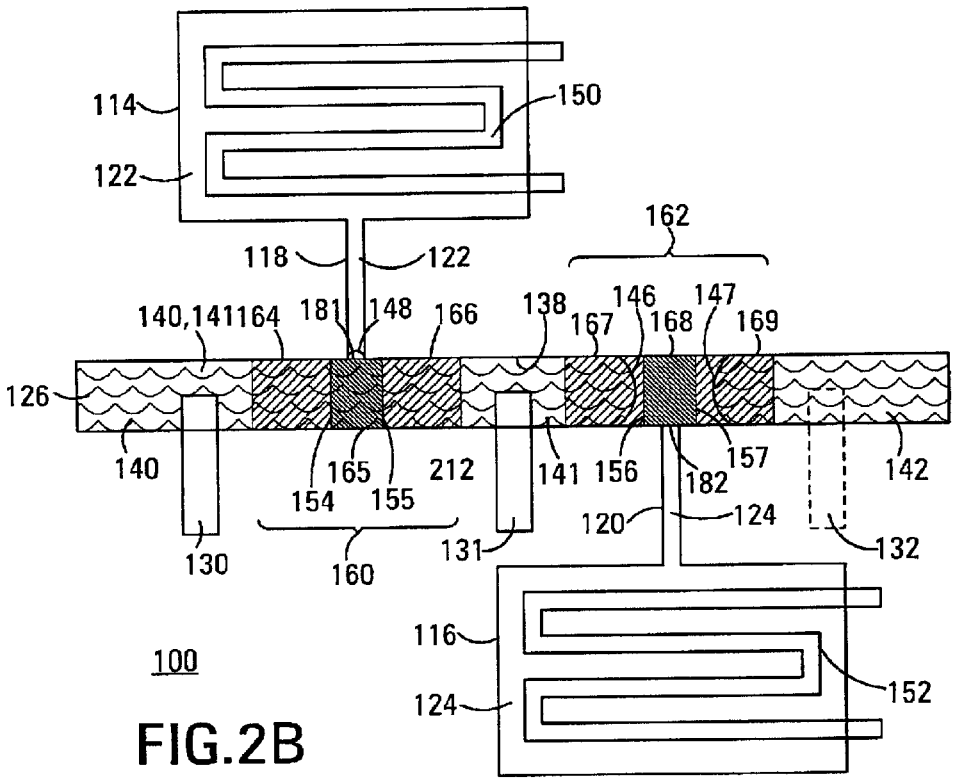
FIG. 2B is a plan view of the conductive liquid-based switch device shown in FIG. 2A in a second switching state.

FIGS. 2A and 2B are plan views of a first embodiment 100 of a conductive liquid-based latching switch device according to the invention. Switch device 100 is composed of passage 112, cavities 114 and 116, channels 118 and 120, non-conductive fluid 122 and 124, conductive liquid 126, electrodes 130 and 131 and latching structures 160 and 162 associated with channels 118 and 120, respectively.

Passage 112 is elongate. Channel 118 extends from cavity 114 to the passage and channel 120 extends from cavity 116 to the passage. The channels are spatially separated from one another along the length of the passage. Thus, channel 118 and channel 120 are laterally offset from one another along the length of the passage. Channel 118 and 122 have substantially smaller cross-sectional dimensions than the passage to establish energy barriers 181 and 182, respectively, between the passage and the channels. Energy barriers 181 and 182 will be described further below.

Electrodes 130 and 131 are electrical contact with conductive liquid 126 and are located on opposite sides of channel 118. An optional third electrode 132 is also shown. The switch device includes the two electrodes 130 and 131 in embodiments in which it is configured as a single-throw switch. The switch device additionally includes third electrode 132 in embodiments in which it is configured as a double-throw switch. Electrode 132 is in electrical contact with the conductive liquid. Electrodes 131 and 132 are located on opposite sides of channel 120.

Non-conductive fluid 122 is located in cavity 114 and in channel 118. Non-conductive fluid 124 is located in cavity 116 and in channel 120.

Conductive liquid 126 is located in passage 112. The volume of the conductive liquid is less than that of the passage so that the conductive liquid incompletely fills the passage. The remaining volume of the passage is occupied by non-conductive fluid 122 or 124, depending on the switching state of switch device 100. The conductive liquid can be regarded as being composed of the three conductive liquid portions 140, 141 and 142. However, except during switching transitions, conductive liquid 126 exists as only two conductive liquid portions having dissimilar sizes. For example, FIG. 2A shows conductive liquid 126 existing as conductive liquid portion 140 and conductive liquid portion 141, 142.

Each conductive liquid portion has a surface in contact with non-conductive fluid 122 or 124. Such surface will be called a free surface to distinguish it from a surface of the conductive liquid portion bound by channel 112. In FIG. 2A, the free surface of conductive liquid portion 140 is shown at 144 and that of conductive liquid portion 141, 142 is shown at 145. In FIG. 2B, the free surface of conductive liquid portion 140, 141 is shown at 146 and that of conductive liquid portion 142 is shown at 147. The free surface of a conductive liquid portion has a surface energy that depends on the surface tension of the conductive liquid and the reciprocal of the radius of curvature of the free surface. The radius of curvature depends, in part, on the cross-sectional dimensions of passage 112 and the wetting properties of the wall 138 of the passage where the free surface meets the wall of the passage.

Heaters, shown schematically at 150 and 152, are located in cavities 114 and 116, respectively. Heat generated by one of the heaters causes non-conductive fluid 122 or 124 to expand. The resulting excess volume of the non-conductive fluid is expelled into passage 112 through the respective one of channels 118 or 120. In one switching state of switch device 100, non-conductive fluid 124 entering the passage from channel 120 divides conductive liquid portion 141, 142 into conductive liquid portions 141 and 142, and moves conductive liquid portion 141 along the passage into contact with conductive liquid portion 140 to form conductive liquid portion 140, 141. In the other switching state of the switch device, non-conductive fluid 122 entering the passage from channel 118 divides conductive liquid portion 140, 141 into conductive liquid portions 140 and 141, and moves conductive liquid portion 141 along the passage into contact with conductive liquid portion 142 to form conductive liquid portion 141, 142.

In the switching state of switch device 100 shown in FIG. 2A, heat generated by heater 150 has caused non-conductive fluid 122 to expand, and the excess volume of non-conductive fluid 122 has been expelled though channel 118 into passage 112. Non-conductive fluid 122 entering passage 112 has divided conductive liquid portion 140, 141 (FIG. 2B) into conductive liquid portions 140 and 141. Non-conductive fluid 122 entering passage 112 has additionally expelled non-conductive fluid 124 from the passage. This allows conductive liquid portions 141 and 142 (FIG. 2B) to unite to form conductive liquid portion 141, 142. Non-conductive fluid 124 expelled from the passage returns to cavity 116 through channel 120.

In the switching state shown in FIG. 2A, non-conductive fluid 122 isolates conductive liquid portion 140 from conductive liquid portion 141, 142, and electrically insulates electrode 130 in contact with conductive liquid portion 140 from electrode 131 in contact with conductive liquid portion 141. In embodiments that include electrode 132, conductive liquid portion 141, 142 electrically connects electrode 131 to electrode 132.

In the state of switch device 100 shown in FIG. 2B, heat generated by heater 152 has caused non-conductive fluid 124 to expand, and the excess volume of non-conductive fluid 124 has been expelled though channel 120 into passage 112. Non-conductive fluid 124 entering passage 112 has divided conductive liquid portion 141, 142 (FIG. 2A) into conductive liquid portions 141 and 142. Non-conductive fluid 124 entering passage 112 has additionally expelled non-conductive fluid 122 from the passage. This allows conductive liquid portions 140 and 141 (FIG. 2A) to unite to form conductive liquid portion 140, 141. Non-conductive fluid 122 expelled from the passage returns to cavity 114 through channel 118.

In the switching state shown in FIG. 2B, conductive liquid portion 140, 141 electrically connects electrode 130 to electrode 131, and non-conductive fluid 124 isolates conductive liquid portion 142 from conductive liquid portion 140, 141. In embodiments that include the electrode 132, non-conductive fluid 124 electrically insulates electrode 132, which is in contact with conductive liquid portion 142, from electrode 131, which is in contact with conductive liquid portion 140, 141.

In latching switch device 100 according to the invention, passage 112 includes latching structures 160 and 162 associated with channels 118 and 120, respectively. Each latching structure is composed of an energy barrier located between the respective channel and each of the adjacent electrodes. Latching structure 160 is composed of energy barrier 154 and energy barrier 155 located on opposite sides of channel 118. Latching structure 160 is composed of energy barrier 156 and energy barrier 157 located on opposite sides of channel 120. Each energy barrier is formed by the juxtaposition of two longitudinal portions of passage 118, a low surface energy portion and a high surface energy portion arranged in tandem along part of the length of the passage with the high surface energy portion closer to the channel with which the latching structure is associated.

Energy barrier 154 is composed of low surface energy portion 164 and high surface energy portion 165, and energy barrier 155 is composed of low surface energy portion 166 and high surface energy portion 165. High surface energy portion 165 is located in the passage closer to channel 118 than low surface energy portions 164 and 166. Energy barrier 156 is composed of low surface energy portion 167 and high surface energy portion 168, and energy barrier 157 is composed of low surface energy portion 169 and high surface energy portion 168. High surface energy portion 168 is located in the passage closer to channel 120 than low surface energy portions 167 and 169.

Latching structure 160 will now be described in more detail. Latching structure 162 is similar, and so will not be separately described. Low surface energy portion 164 and high surface energy portion 165 are structured relative to one another so that the free surface 144 of conductive liquid portion 140 has a lower surface energy when located in low surface energy portion 164 than when located in high surface energy portion 165. Similarly, low surface energy portion 166 and high surface energy portion 165 are structured relative to one another such that the free surface 145 of conductive liquid portion 141, 142 has a lower surface energy when located in low surface energy portion 166 than when located in high surface energy portion 165. The differing properties of low surface energy portions 164 and 166 and high surface energy portion 165 with respect to the surface energy of the conductive liquid establish energy barriers on opposite sides of channel 118.

As used in this disclosure, a reference to the free surface of a conductive liquid portion being in a certain portion of passage 112 will be taken to refer to the location of where the free surface meets the wall of the passage. For example, in FIG. 2A, free surface 144 is in low surface energy portion 164 because free surface 144 meets the wall 138 of the portion of the passage identified as low surface energy portion 164.

The energy barriers 154 and 155 formed by the juxtaposition of high surface energy portion 165 of passage 112 with low surface energy portions 164 and 166, respectively, hold the free surfaces of conductive liquid portions 140 and 141, 142 on the low energy sides of the energy barriers, i.e., in low surface energy portions 164 and 166. A substantial input of energy is required to move the free surfaces of the conductive liquid portions from the low surface energy portion to the adjacent high surface energy portion.

For example, consider the switching state shown in FIG. 2A. When switch device 100 is switched into this switching state, non-conductive fluid 122 separates conductive liquid portion 140, 141 (FIG. 2B) into conductive liquid portions 140 and 141. Non-conductive fluid 122 moves free surfaces 144 and 145 of conductive liquid portions 140 and 141, respectively, along passage 112 in opposite directions, away from channel 118. Free surfaces 144 and 145 move through high surface energy portion 165 and into low surface energy portions 164 and 166, respectively. Additionally, conductive liquid portion 141 unites with conductive liquid portion 142 to form conductive liquid portion 141, 142.

Figure 1A:
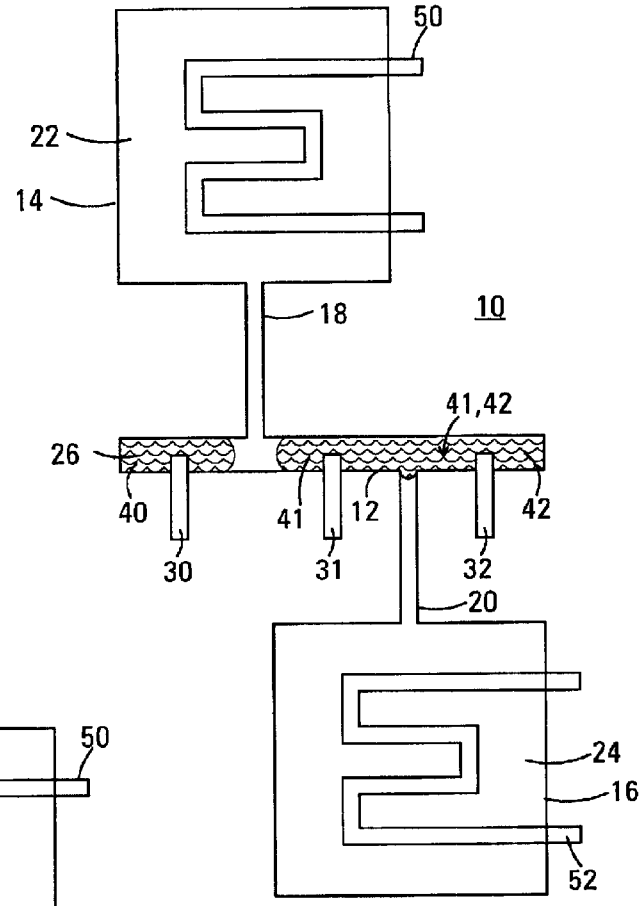
FIG. 1A is a plan view of the conductive liquid-based switch device disclosed in published International Patent Application No. WO 01/46975 in a first switching state.
Figure 1B:
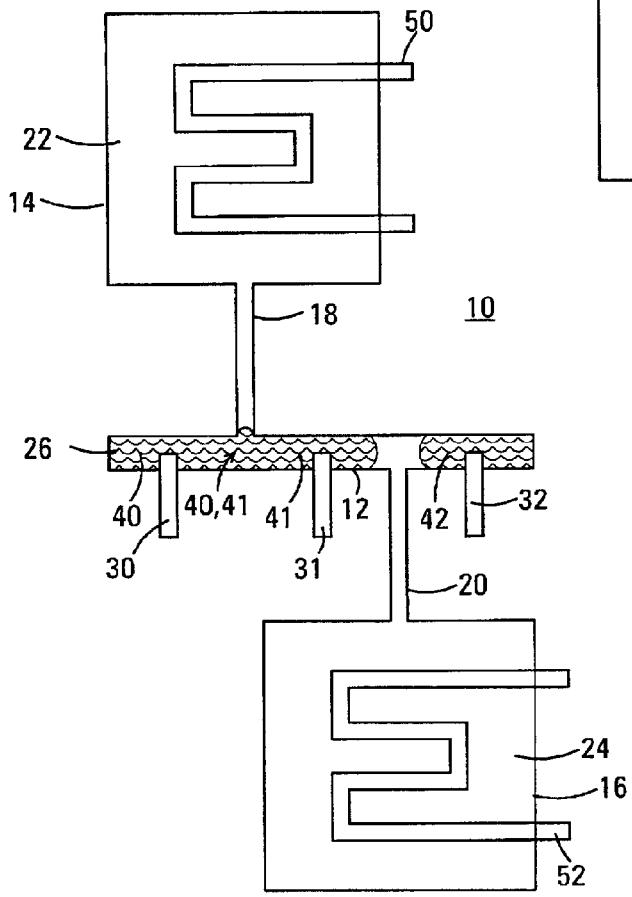
FIG. 1B is a plan view of the conductive liquid-based switch device shown in FIG. 1A in a second switching state.

When heater 150 is de-energized after it has switched switch device 100 to the switching state shown in FIG. 2A, non-conductive fluid 122 cools and contracts. Contraction tends to withdraw non-conductive fluid 122 from the gap between conductive liquid portions 140 and 141, 142. Absent latching structure 160, withdrawal of the non-conductive fluid would potentially allow conductive liquid portions 140 and 141 to unite as described above with reference to FIG. 1A.

In latching switch device 100 according to the invention, however, when heater 150 is de-energized after establishing the switching state shown in FIG. 2A, energy barrier 154 formed by low surface energy portion 164 and high surface energy portion 165 resists movement of free surface 144 of conductive liquid portion 140 into high surface energy portion 165. Similarly, energy barrier 155 formed by low surface energy portion 166 and high surface energy portion 165 resists movement of free surface 145 of conductive liquid portion 141, 142 into high surface energy portion 165. An input of energy greater than that available from the contraction of non-conductive fluid 122 is required to move the surfaces of conductive liquid portions 140 and 141, 142 over energy barriers 154 and 155, respectively, across high surface energy portion 165 and into contact with one another. Thus, latching structure 160 maintains the electrical connection between electrodes 130 and 131 in an open state.

Moreover, since energy barrier 155 holds free surface 145 of conductive liquid portion 141, 142 apart from channel 118, latching structure 160 substantially reduces the likelihood of conductive liquid portion 141, 142 fragmenting into conductive liquid portions 141 and 142 that open the electrical connection between electrodes 131 and 132. Consequently, latching structure 160 maintains latching switch device 100 in the switching state shown in FIG. 2A after heater 150 has been de-energized.

The input of energy required to move free surfaces 144 and 145 of conductive liquid portions 140 and 141, 142 over energy barriers 154 and 155 and into contact with one another is less than that available from the expansion of non-conductive fluid 124 in response to heater 152. Thus, energizing heater 152 provides sufficient energy to move conductive liquid portions 140 and 141 into contact with one another to switch the switch device 100 to the switching state shown in FIG. 2B.

Similarly, when heater 152 is de-energized after establishing the switching state shown in FIG. 2B, latching structure 162 formed by low surface energy portions 167 and 169 and high surface energy portion 168 holds free surfaces 146 and 147 of conductive liquid portions 140, 141 and 142 apart from one another. An input of energy greater than that available from the contraction of non-conductive fluid 124 is required to move free surfaces 146 and 147 over energy barriers 156 and 157 and into contact with one another. As a result, latching structure 162 maintains the electrical connection between electrodes 131 and 132 in an open state.

Moreover, since energy barrier 156 holds the free surface 146 of conductive liquid portion 140, 141 apart from channel 120, latching structure 162 substantially reduces the likelihood of conductive liquid portion 140, 141 fragmenting into conductive liquid portions 140 and 141 that open the electrical connection between electrodes 130 and 131. Consequently, latching structure 162 maintains switch device 100 in the switching state shown in FIG. 2B after heater 152 has been de-energized.

The input of energy required to move free surfaces 146 and 147 of conductive liquid portions 140, 141 and 142 over energy barriers 156 and 157, respectively and into contact with one another is less than that available from the expansion of non-conductive fluid 122 in response to heater 150. Thus, energizing heater 150 provides sufficient energy to move conductive liquid portions 141 and 142 into contact with one another to establish the switching state shown in FIG. 2A.

It should be noted that latching structure 160 directly holds free surfaces 144 and 145 to keep conductive liquid portions 140 and 141, 142 apart and maintain the switch device in the switching state shown in FIG. 2A. The latching structure is not connected to the free surfaces by a thread of conductive liquid whose form can change and allow the conductive liquid portions to come into contact with one another. Similar remarks apply with respect to latching structure 162.

The ability of latching structure 160 to prevent conductive liquid portion 141, 142 from changing its form and, hence, changing the switching state of switch device 100 is dependent in part on the energy barrier 182 that exists at the intersection of channel 142 and passage 112. Energy barrier 182 holds the free surface 149 of conductive liquid portion 141, 142 at channel 142 and thus prevents free surface 149 from advancing into the channel and providing conductive liquid portion 141, 142 with the ability to change its form.

Energy barrier 182 is formed by structuring channel 120 to have substantially smaller cross-sectional dimensions than passage 112, as described above. As a result of the smaller cross-sectional dimensions, free surface 149 would have a substantially higher surface energy in channel 142 than in passage 112, and an input of energy would be required to move free surface 149 from the passage into the channel. Thus, since free surfaces 145 and 149 of conductive liquid portion 141, 142 are held by energy barriers, and conductive liquid portion 141, 142 is otherwise bounded by the passage, the ability of conductive liquid portion 141, 142 to change its form and open the electrical connection between electrodes 131 and 132 is substantially reduced.

If hydraulic or pneumatic losses in channel 120 are a concern, the channel may be shaped to include a constriction in which the channel has substantially smaller cross-sectional dimensions than passage 112 over only part of its length. The constriction may be located at the intersection of the channel and the passage, for example.

A ratio between the cross-sectional dimensions of channel 120 and those of passage 112 of less than about 0.9 will form energy barrier 182 with a height sufficient to hold free surface 149. However, a smaller value of this ratio will provide a greater resistance to environmental stimuli such as shock and temperature changes. In some practical examples, a ratio in the range from about 0.3 to about 0.5 was used.

Figure 3A:
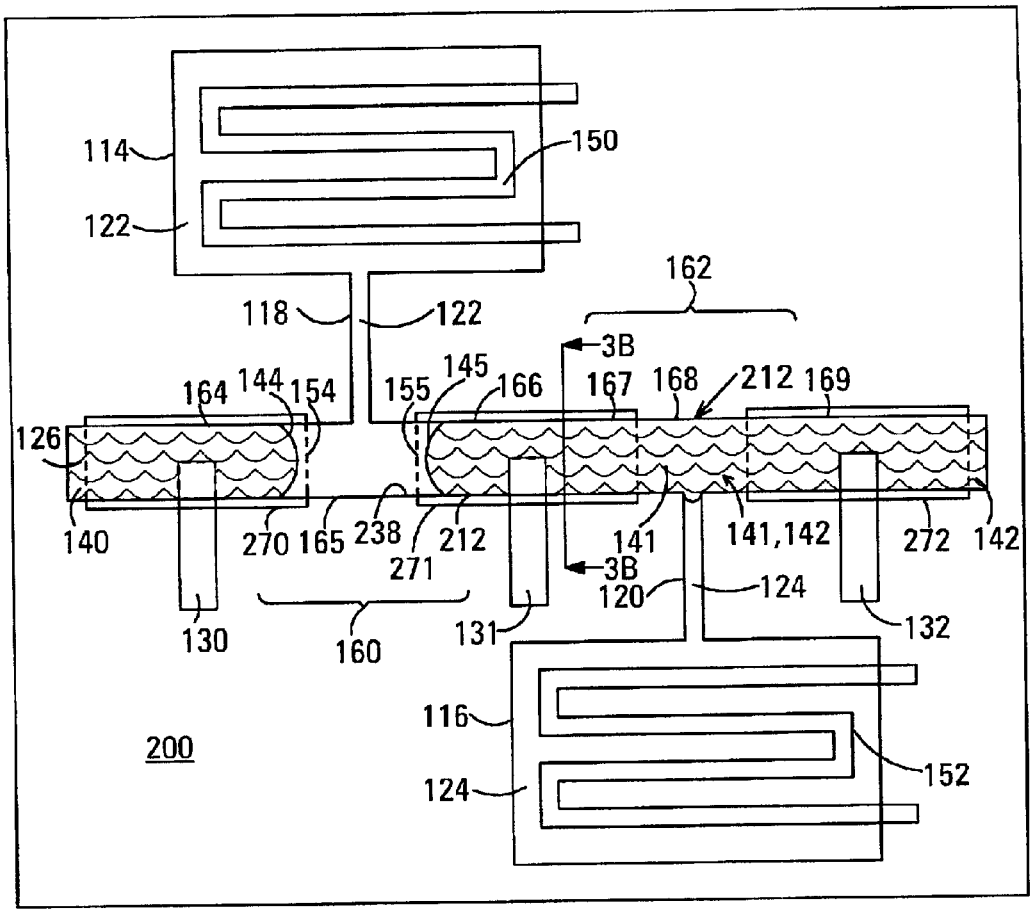
FIG. 3A is a plan view of part of a second embodiment of a conductive liquid-based switch device according to the invention.
Figure 3B:
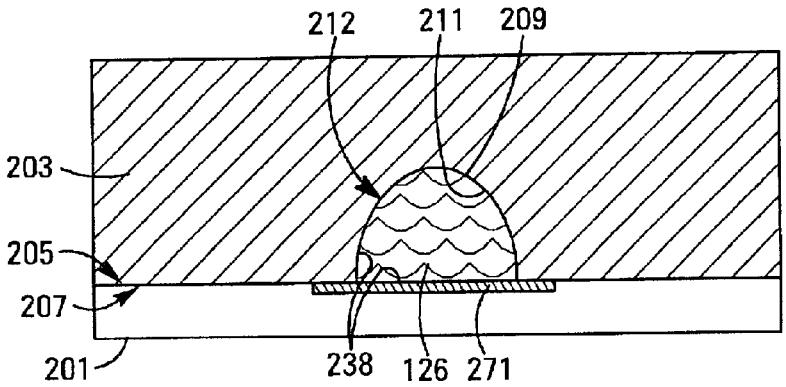
FIG. 3B is a cross-sectional view of part of the passage of a first example of the switch device shown in FIG. 3A.

FIG. 3B shows energy barrier 181 that holds the free surface 148 of conductive liquid portion 140, 141 at channel 118. Thus, since both free surfaces 146 and 148 of conductive liquid portion 140, 141 are held by energy barriers, and conductive liquid portion 140, 141 is otherwise bounded by channel 112, the ability of conductive liquid portion 140, 141 to change its form and open the electrical connection between electrodes 130 and 131 is substantially reduced. Energy barrier 181 is similar to energy barrier 182, and so will not be further described.

FIG. 3A is a plan view of part of a second embodiment 200 of a liquid conductor-based latching switch device according to the invention. Switch device 200 is shown in a switching state corresponding to the switching state described above with reference to FIG. 2A. It will be apparent to the person of ordinary skill in the art that the switch device has an alternative switching state corresponding to that described above with reference to FIG. 2B. Switch device 200 is shown configured as a double-throw switch and therefore includes the optional third electrode 132. In a single-throw configuration, electrode 132 would be omitted. Elements of switch device 200 that correspond to elements of switch device 100 described above with reference to FIGS. 2A and 2B are indicated by the same reference numerals and will not be described again in detail.

In switch device 200, passage 212 is elongate and has substantially constant cross-sectional dimensions along its length. Low surface energy portion 164 of latching structure 160 is composed of high-wettability layer 270. Low surface energy portion 166 of latching structure 160 and low surface energy portion 167 of latching structure 162 are collectively composed of high-wettability layer 271. Low surface energy portion 169 of latching structure 162 is composed of high-wettability layer 272. The high-wettability layers each cover at least part of the portions of wall 238 of passage 212 located in low surface energy portions 164, 166, 167 and 169 of the passage.

The portions of the wall 238 of passage 212 located in high surface energy portion 165 of latching structure 160 and in high surface energy portion 168 of latching structure 162 are not covered by high-wettability layers. The high-wettability layers are each composed of a material having a greater wettability with respect to conductive liquid 126 than the portions of wall 238 located in high surface energy portions 165 and 168 of the passage. The higher wettability of the high-wettability layers reduces the angle of contact between the free surface of a conductive liquid portion and the high-wettability layer when the free surface is located adjacent the high-wettability layer. This in turn increases the radius of curvature of the free surface and reduces the surface energy of the free surface. Thus, high-wettability layers 270 and 271 and the portion of wall 238 constituting high surface energy portion 165 of the passage form energy barriers 154 and 155 located on opposite sides of channel 118. Similarly, high-wettability layers 271 and 272 and the portion of wall 238 constituting high surface energy portion 168 of the passage form energy barriers 156 and 157 located on opposite sides of channel 120.

Figure 3C:
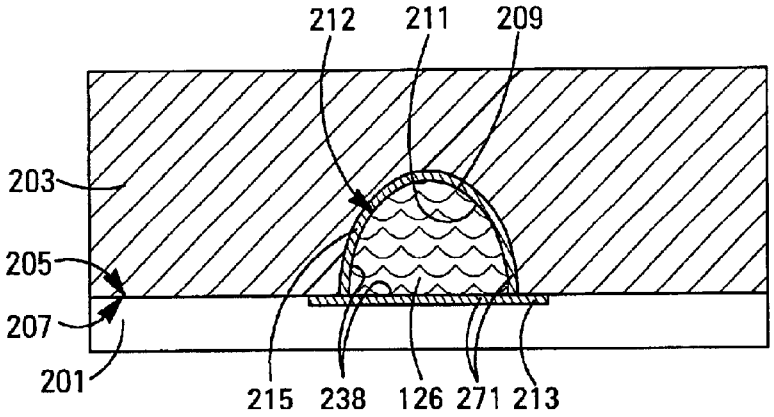
FIG. 3C is a cross-sectional view of part of the passage of a second example of the switch device shown in FIG. 3A.
Figure 3D:
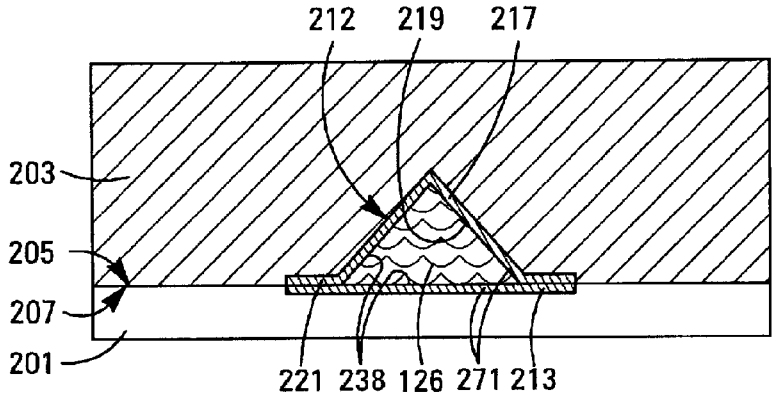
FIG. 3D is a cross-sectional view of part of the passage of a third example of the switch device shown in FIG. 3A.

Three examples of the structure of low surface energy portion 167 of channel 212 of latching switch device 200 are shown in the enlarged cross-sectional views of FIGS. 3B, 3C and 3D. These, and other features of the structure of latching switch device 200 will be described with reference to these Figures, and with additional reference to FIG. 3A. The cross-sectional views are taken along the section line 3B—3B shown in FIG. 3A. The section line intersects low surface energy portion 167, but cross-sectional views taken along section lines intersecting low surface energy portions 164, 166 and 169 would look substantially the same. Accordingly, the structure of low surface energy portions 164, 166 and 169 will not be separately described.

Turning first to FIG. 3B, latching switch device 200 is fabricated in the substrates 201 and 203. The material of the substrates is an electrically-insulating material, such as a glass, a ceramic or a semiconductor, that has a relatively low wettability with respect to conductive liquid 126. Major surface 205 of substrate 201 is substantially plane, and the elements of the latching switch device, including cavities 114 and 116, channels 118 and 120 and passage 212, extend depthwise into substrate 203 from major surface 207. Processes for forming such elements in a substrate by such methods as wet or dry etching or ablation are known in the art and will not be described here.

FIGS. 3B and 3C show examples in which substrate 203 is a wafer of glass, a semiconductor, such as silicon, or a ceramic, such as alumina or beryllia, in which trench 209 is formed by an ablation process, such as blasting using particles of alumina. The trench has a substantially U-shaped cross-sectional shape. Other cross-sectional shapes, such as square, rectangular, trapezoidal, semi-circular and semi-elliptical, are possible. Trench 209 provides part of passage 212, and the wall 211 of trench 209 provides part of the wall 238 of the passage. The remainder of the wall 238 is provided by the part of the major surface 205 of substrate 201 that overlaps the trench.

The portions of the part of the major surface 205 of substrate 201 that overlap trench 209 in low surface energy portions 164, 166, 167 and 169 of passage 212 are covered by high-wettability layers 270, 271 and 272. High-wettability layer 271 is shown. Processes for depositing layers of high-wettability materials, such as metals, on the major surface of a substrate are known in the art and will not be described here.

Latching switch device 200 is assembled with the major surfaces 205 and 207 of substrates 201 and 203, respectively, juxtaposed. Assembling switch device 200 locates the high-wettability material of the high-wettability layers 270, 271 and 272 at the low surface energy portions 164, 166, 167 and 169 of passage 212. Low surface energy portions 164 and 166 are on opposite sides of channel 118 and low surface energy portions 167 and 169 are on opposite sides of channel 120, as shown in FIG. 3A. A predetermined volume of conductive liquid, less than that of passage 212, is placed in trench 209 prior to assembly. If non-conductive fluid 122 and 124 is a liquid, cavities 112 and 114 and channels 118 and 120 are filled with non-conductive fluid prior to assembly. If the non-conductive fluid is a gas, assembly is performed in an atmosphere of the gas so that the gas fills the cavities and the channels.

In the example shown in FIG. 3B, high-wettability layers 270, 271 and 272 are located only on the major surface 205 of substrate 201. Even though the high-wettability layers 270, 271 and 272 each cover only part of the perimeter of passage 212 in low surface energy portions 164, 166, 167 and 169, i.e., the part of the perimeter provided by the major surface 205 of substrate 201, they lower the surface energy of the free surfaces of conductive liquid 126 relative to that of the free surfaces when located in the high surface energy portions 165 and 168. The lowering of the surface energy is enough to form effective energy barriers in the passage on opposite sides of channels 118 and 120, as described above.

In the example shown in FIG. 3C, high-wettability layer 271 substantially covers the perimeter of passage 212 in low surface energy portion 167. High wettability layer 271 includes layer portion 213 located on the major surface 205 of substrate 201 and additionally includes layer portion 215 located on the wall 211 of trench 209. Processes for depositing layers of high-wettability materials, such as metals, to cover selected portions of the wall of a trench formed in a substrate are known in the art and will not be described here.

FIG. 3D shows an example in which the substrate 203 is a wafer of silicon and the trench 217 has a V-shaped cross-section. In this example, the trench 217 is formed by an isotropic etching process. The wall 219 of the trench provides part of the wall 238 of passage 212. The remainder of the wall 238 is provided by the part of the major surface 205 of substrate 201 that overlaps the trench, as described above. The high-wettability layer 271 includes layer portion 213 located on the major surface 205 of substrate 201 and additionally includes the layer portion 221 located on the wall 219 of trench 217. Processes for depositing layers of high-wettability materials, such as layers of a suitable metal, in a trench formed in a substrate are known in the art and will not be described here.

In the examples shown in FIGS. 3C and 3D, high-wettability layer 271 substantially covers the perimeter of passage 212 in low surface energy portions 166 and 167. The surface energy of free surfaces 145 and 146 (FIG. 2B) of conductive liquid 126 is lower in low surface energy regions 166 and 167, and the energy barriers are therefore higher, than in low surface energy regions 166 and 167 of the example shown in FIG. 3B in which high-wettability layer 271 covers only the portion of the perimeter of passage 212 provided by the major surface 205 of substrate 201.

In the example shown in FIG. 3D, high-wettability layer portion 221 may be omitted. In this case, high-wettability layer 271 covers only the part of the perimeter of passage 212 provided by the major surface 205 of substrate 201 in an arrangement similar to that shown in FIG. 3A. In further variations, high-wettability layer portion 213 may be omitted from the examples shown in FIGS. 3C and 3D. In these cases, high-wettability layer 271 is composed only of layer portion 215 located on the surface 211 of trench 209 (FIG. 3C) or of layer portion 221 located on the surface 219 of trench 217 (FIG. 3D).

In a practical example of the latching switch device 200, conductive liquid 126 was mercury, the high-wettability material of high-wettability layers 270, 271 and 272 was platinum and non-conductive fluid 122 and 124 was nitrogen. Alternative conductive liquids include gallium, sodium-potassium or another conductive material that is liquid at the operating temperature of the switch device. Alternative high-wettability materials include lithium, ruthenium, nickel, palladium, copper, silver, gold and aluminum. Alternative non-conductive fluids include argon, helium, carbon dioxide, other inert gases and gas mixtures and non-conducting organic liquids and gases, such as fluorocarbons.

In practical examples, trench 217 was about 0.1 to about 0.2 mm wide, about 0.1 mm or about 0.2 mm deep and about 1 mm to about 3 mm long. The trenches that, when covered by substrate 201, constitute channels 118 and 120 were about 30 $\mu$m to about 100 $\mu$m wide and about 30 $\mu$m to about 100 $\mu$m deep, but were narrower and shallower than trench 217. The trenches were formed in a substrate of glass by ablation. Accordingly, in this example, the material of the wall 238 of passage 212 located in the high surface energy portions 165 and 168 was glass. Glass has a significantly lower wettability with respect to such conductive liquids as mercury and gallium than the high-wettability material of high-wettability layers 270–272.

The above-described materials and dimensions are also suitable for use in the other conductive liquid-based latching switch devices described herein.

Materials other than glass, semiconductor or ceramic may be used as substrates 201 and 203. For example, the elements of the switch device may be molded in a substrate 203 of a moldable plastic material. A similar material may be used for substrate 201. Some of such alternative substrate materials may have a relatively high wettability with respect to conductive liquid 126. In embodiments of latching switch device 200 in which the wettability of the substrate materials with respect to the conductive liquid differs insufficiently from that of the high-wettability material, high surface energy regions 165 and 168 may be formed in the passage 212 by covering the portions of the wall 238 located in high surface energy portions 165 and 168 of the passage with a low-wettability layer (not shown). The low-wettability layer is a layer of a low-wettability material having a substantially lower wettability with respect to the conductive liquid than the high-wettability material of the high-wettability layers 270–272. In an embodiment that includes low-wettability layers in the high surface energy portions 165 and 168, and in which the materials of substrates 201 and 203 have a high wettability with respect to conductive liquid 126, high-wettability layers 270–272 may be omitted.

Figure 3E:
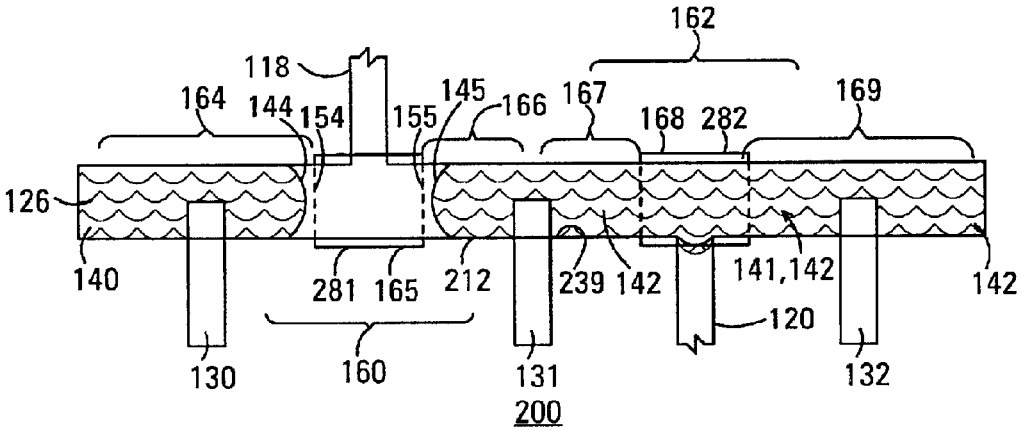
FIG. 3E is a plan view of part of a variation on the switch device shown in FIG. 3A.

FIG. 3E shows an example of latching switch device 200 in which the material of at least substrate 203 has a high wettability with respect to conductive liquid 126. The portions of wall 279 located in the low surface energy portions 164, 166, 167 and 169 of passage 212 are exposed to the conductive liquid. Low-wettability layers 281 and 282 cover at least the part of the periphery of channel 212 provided by the major surface 205 of substrate 201 in the high surface energy portions 165 and 168 of the passage. The low-wettability layers may alternatively cover the entire periphery of passage 212 in high surface energy portions 165 and 168 in a manner similar to the high-wettability layer 271 shown in FIG. 3B, 3C or 3D.

Figure 4:
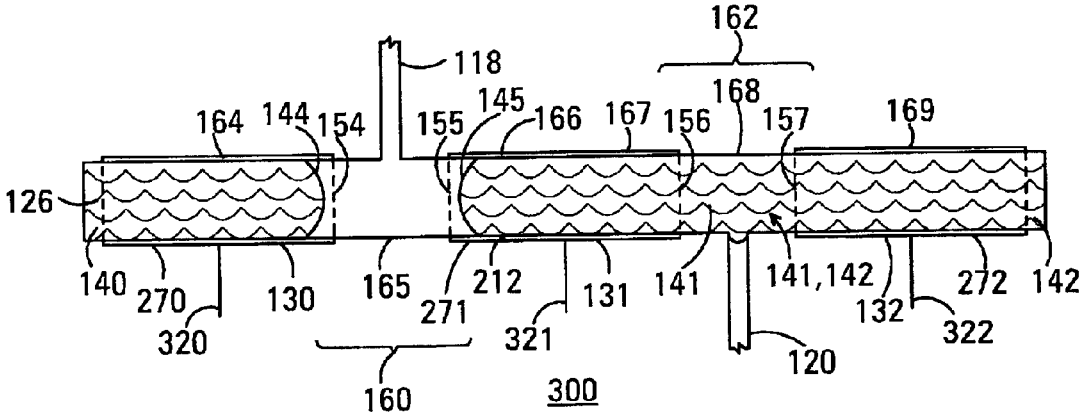
FIG. 4 is a plan view of part of a third embodiment of a conductive liquid-based switch device according to the invention.

FIG. 4 is a plan view of a third embodiment 300 of a liquid conductor-based latching switch device according to the invention. Switch device 300 is shown in a switching state corresponding to the switching state described above with reference to FIG. 2A. It will be apparent to the person of ordinary skill in the art that switch device 300 has an alternative switching state corresponding to that described above with reference to FIG. 2B.

To simplify the drawing, only passage 212 and parts of channels 118 and 120 of switch device 300 are shown. The remaining elements of the switch device are identical to corresponding elements of switch device 200 described above with reference to FIGS. 3A and 3B. Elements of switch device 300 that correspond to elements of switch devices 100 and 200 described above with reference to FIGS. 2A, 2B and 3A–3D are indicated by the same reference numerals and will not be described again in detail.

As in switch device 200, the low surface energy portions 164, 166 and 167, 169 of latching structures 160 and 162, respectively, are composed of high-wettability layers 270, 271 and 272, respectively. The high-wettability layers each cover at least part of the periphery of passage 212 in each of the low surface energy portions of the passage and are each composed of a high-wettability material. The high-wettability material has a higher wettability with respect to the conductive liquid 126 than the portion of the wall 238 constituting the high surface energy portions 164 and 166 of the passage.

In the latching switch device 300, the high-wettability material of the high-wettability layers 270, 271 and 272 is a conductive material, such as a metal. Electrical connections 320, 321 and 322 are made to the high-wettability layers 270, 271 and 272, respectively. With the electrical connections, high-wettability layers 270, 271 and 272 additionally function as electrodes 130, 131 and 132, respectively. Thus, in latching switch device 300, electrodes 130, 131 and 132 are integral with high-wettability layers 270, 271 and 272. Fabrication of switch device 300 is simplified by not having to fabricate electrodes independently of the high-wettability layers. Electrical connection 322 may be omitted in an embodiment of latching switch device 300 configured as a single-throw switch.

Conductive liquid-based switch devices 200 and 300 have been described above with reference to examples in which a single high-wettability layer 271 provides both low surface energy portion 166 and low surface energy portion 167. However, this is not critical to the invention. Individual high-wettability layers may be located in passage 212 to provide low surface energy portion 166 and low surface energy portion 167.

Figure 5:
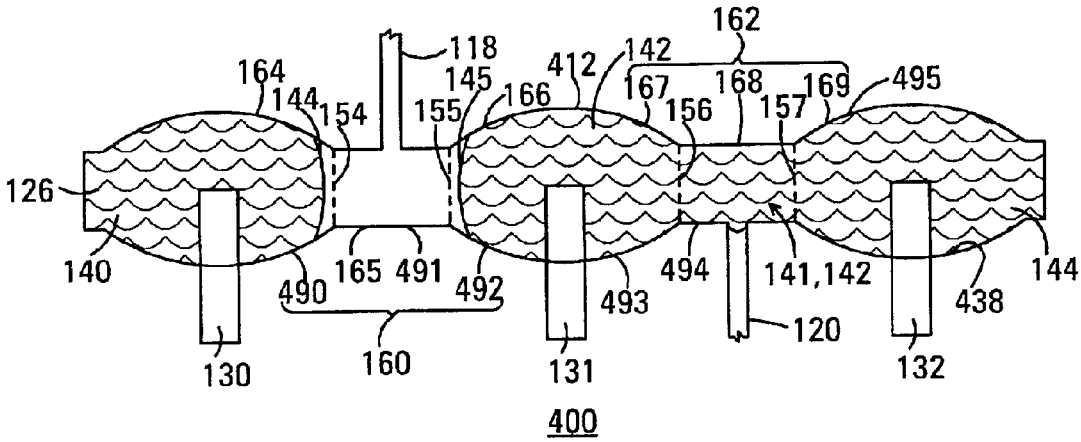
FIG. 5 is a plan view of part of a fourth embodiment of a conductive liquid-based switch device according to the invention.

FIG. 5 is a plan view of a fourth embodiment 400 of a liquid conductor-based latching switch device according to the invention. To simplify the drawing, only passage 412 and parts of channels 118 and 120 are shown. The elements of the switch device not shown are identical to corresponding elements of switch device 100 described above with reference to FIGS. 2A and 2B. Elements of switch device 400 that correspond to elements of switch device 100 described above with reference to FIGS. 2A and 2B are indicated by the same reference numerals and will not be described again in detail.

In latching switch device 400, the wettability of the material of the wall 438 of passage 412 with respect to conductive liquid 126 is substantially uniform along the length of the passage. High surface energy portions 165 and 168 of the passage have relatively small cross-sectional dimensions and low surface energy portions 164, 166, 167 and 169 of the passage have cross-sectional dimensions that are larger than those of the high surface energy portions. In the example shown, the cross-sectional dimensions of the low surface energy portions progressively increase with increasing distance from the corresponding one of channels 118 and 120.

Passage 412 is shaped to include regions 490, 491, 492, 493, 494 and 495 arranged in tandem along the length of the passage. Region 491 is located at channel 118. Region 494 is located at channel 120. Regions 491 and 494 each have substantially constant cross-sectional dimensions that are smaller than the average cross sectional dimensions of each of the regions 490, 492, 493 and 495. Free surfaces 144 and 145 of conductive liquid 126, when located in region 491, have a relatively small radius of curvature and, hence, a high surface energy. Free surfaces corresponding to free surfaces 146 and 147, when located in region 494, have a relatively small radius of curvature and, hence, a high surface energy.

Regions 490 and 492 are located on opposite sides of region 491. Regions 490 and 492 have minimum cross-sectional dimensions at their interfaces with region 491, and progressively increase in cross-sectional dimensions with increasing distance from region 491. Regions 493 and 495 are located on opposite sides of region 494. Regions 493 and 495 have minimum cross-sectional dimensions at their interfaces with region 494, and progressively increase in cross-sectional dimensions with increasing distance from region 494. Regions 492 and 493 are joined at their widest parts. Regions 491 and 495 are shown with their cross-sectional dimensions reaching a maximum and then reducing with increasing distance from regions 491 and 494, respectively. However, this is not critical: the cross-sectional dimensions of regions 491 and 495 need not reduce after reaching a maximum.

Latching structure 160 will now be described in detail. Latching region 162 is similar and will not be separately described. Free surfaces 144 and 145 of conductive liquid 126, when located in regions 490 and 492, respectively, have a radius of curvature larger than in region 491, and, hence, a lower surface energy than in region 491. Moreover, the radius of curvature of the free surfaces decreases and the surface energy increases as the cross-sectional dimensions of the region decrease, i.e., with decreasing distance from channel 118. Thus, an input of energy is required to move free surface 144 and 145 towards channel 118.

Regions 491 and 490 form energy barrier 154 that holds free surface 144 of conductive liquid portion 140 apart from channel 118. Regions 491 and 492 form energy barrier 155 that holds free surface 145 of conductive liquid portion 141 apart from channel 118. Energy barriers 154 and 155 therefore hold conductive liquid portion 140 apart conductive liquid portion 141. Regions 490–492 constitute latching structure 160 that holds switch device 400 in a switching state corresponding to the switching state shown in FIG. 2A. Similarly, regions 493–495 constitute latching structure 162 that holds the switch device in a switching state corresponding to the switching state shown in FIG. 2B.

The rate of change of cross-sectional dimensions of regions 490, 492, 493 and 495 with increasing distance from regions 491 and 494 may be greater than shown.

Conductive liquid-based latching switch 400 has been described above with reference to an example in which the wall 438 of passage 412 has a uniform wettability with respect to conductive liquid 126. However, the height of energy barriers 154–157 can be increased by making the wettability of the portions of wall 438 located in the regions 490, 492, 493 and 495 greater than of the portions of the wall located in regions 491 and 494. In this case, the difference in the surface energy of the free surfaces of the conductive liquid between low surface energy portions 164, 166, 167 and 169 and high surface energy portions 165 and 168 is achieved by a combination of a greater wettability of wall 478 and larger cross-sectional dimensions in the low surface energy portions compare with the high surface energy portions.

Conductive liquid-based latching switch 400 has been described above with reference to an example in which region 493 is directly connected to region 492. However, this is not critical to the invention. Region 493 may be connected to region 492 by another region (not shown) of passage 412 having an arbitrary length.

The invention has been described with reference to examples in which heaters 150 and 152 are composed of resistors located in cavities 114 and 116, respectively. However, this is not critical to the invention. Non-conductive fluid 122 and 124 may be heated in other ways. For example, cavities 114 and 116 may each be equipped with a radiation absorbing surface, and radiation from a suitable emitter, such as an LED, may be used to heat the non-conductive fluid via the radiation absorbent surface in the respective cavity. Alternatively, a radiation-absorbent non-conductive fluid may be directly heated by radiation of the appropriate wavelength.

This disclosure describes the invention in detail using illustrative embodiments. However, it is to be understood that the invention defined by the appended claims is not limited to the precise embodiments described.

We claim:

1. A latching switch device, comprising:

a passage, the passage being elongate and having a length;

a first cavity and a second cavity;

a channel extending from each cavity to the passage, the channels being spatially separated from one another along the length of the passage;

non-conductive fluid located the cavities;

a conductive liquid located in the passage, the conductive liquid including free surfaces;

a first electrode and a second electrode in electrical contact with the conductive liquid and located on opposite sides of one of the channels; and a latching structure associated with each channel, each latching structure including energy barriers located in the passage on opposite sides of the channel, the energy barriers interacting with the free surfaces of the conductive liquid to hold the free surfaces apart from one another.

2. The latching switch device of claim 1, in which each of the energy barriers includes a first portion of the passage juxtaposed with a second portion of the passage.

3. The latching switch device of claim 2, in which the portions of the passage differ in wettability with respect to the conductive liquid.

4. The latching switch device of claim 3, in which:

one of the first portion of the passage and the second portion of the passage is closer to the channel than the other; and the one of the first portion of the passage and the second portion of the passage that is closer to the channel has a lower wettability with respect to the conductive liquid than the other.

5. The latching switch device of claim 2, in which the portions of the passage differ in cross-sectional dimensions.

6. The latching switch device of claim 1, in which:

the channels each have a length; and the channels have smaller cross-sectional dimensions than the passage over at least part of their length.

7. A latching switch device, comprising:

a passage, the passage being elongate and having a length;

a first cavity and a second cavity;

a channel extending from each cavity to the passage, the channels being spatially separated from one another along the length of the passage;

non-conductive fluid located the cavities;

a conductive liquid located in the passage; and a first electrode and a second electrode in electrical contact with the conductive liquid and located on opposite sides of one of the channels; in which:

the passage includes a latching structure associated with each channel, each latching structure comprising a low surface energy portion of the passage and a high surface energy portion of the passage arranged in tandem along part of the length of the passage with the high surface energy portion closer to the channel, a free surface of the conductive liquid having a lower surface energy in the low surface energy portion than in the high surface energy portion.

8. The latching switch device of claim 7, in which:

the passage includes a wall; and the wall is of materials that differ between the high surface energy portion and low surface energy portions.

9. The latching switch device of claim 8, in which the material of the wall in the low surface energy portions has a higher wettability with respect to the conductive liquid than the material of the wall in the high surface energy portion.

10. The latching switch device of claim 8, in which:

the wall is of a material that extends substantially the length of the passage, the material of the wall having a first wettability with respect to the conductive liquid; and the wall supports a layer of a high-wettability material located in the low surface energy portion, the high-wettability material having a higher wettability than the first wettability with respect to the conductive liquid.

11. The latching switch device of claim 8, in which:

the wall is of a material that extends substantially the length of the passage, the material of the wall having a first wettability with respect to the conductive liquid; and the wall supports a layer of a low-wettability material located in the high surface energy portion, the low-wettability material having a lower wettability than the first wettability with respect to the conductive liquid.

12. The latching switch device of claim 8, in which the low surface energy portion comprises a layer of metal supported by the wall.

13. The latching switch device of claim 12, in which the layer of metal is integral with one of the electrodes.

14. The latching switch device of claim 12, in which the layer of metal substantially surrounds the passage.

15. The latching switch device of claim 8, in which:

the passage has first cross-sectional dimensions in the high surface energy portion; and the passage has second cross-sectional dimensions, greater than the first cross-sectional dimensions, in the low surface energy portion.

16. The latching switch device of claim 8, in which, in the low surface energy portion, the second cross-sectional dimensions progressively increase with increasing distance from the high surface energy portion.

17. The latching switch device of claim 8, in which:

the passage has cross-sectional dimensions; and the cross-sectional dimensions of the passage increase abruptly between the high surface energy portion and the low surface energy portion.

18. The latching switch device of claim 7, additionally comprising a third electrode in contact with the conductive liquid and located on the opposite side of the other of the channels.

19. The latching switch device of claim 7, in which:

the low surface energy portion is a first low surface energy portion;

the latching structure additionally includes a second low energy portion arranged in tandem with the first low surface energy portion and the high surface energy portion; and the first low surface energy portion and the second low surface energy portion are on opposite sides of the high surface energy portion.

20. The latching switch device of claim 7, in which:

the channels each have a length; and the channels have smaller cross-sectional dimensions than the passage over at least part of their length.

* * * * *